United States Patent [19]

Freisler et al.

[11] 4,274,449

[45] Jun. 23, 1981

[54] BAND GUIDE FOR SHUTTLELESS LOOMS

[75] Inventors: Erhard Freisler, Bubikon; Friedrich Lutz, Dürnten; Hans Zollinger, Tann-Rüti, all of Switzerland

[73] Assignee: Ruti Machinery Works Ltd., Ruti, Switzerland

[21] Appl. No.: 43,328

[22] Filed: May 29, 1979

[30] Foreign Application Priority Data

May 31, 1978 [CH] Switzerland ..... 5951/78
Apr. 9, 1979 [CH] Switzerland ..... 3359/79

[51] Int. Cl.[3] ..... D03D 47/12
[52] U.S. Cl. ..... 139/449
[58] Field of Search ..... 139/441, 443, 444, 445, 139/446, 449

[56] References Cited

U.S. PATENT DOCUMENTS

| | | | |
|---|---|---|---|
| 2,065,746 | 12/1936 | Robertson | 139/449 |
| 2,604,123 | 7/1952 | Budzyna et al. | 139/449 |
| 3,198,215 | 8/1965 | Tinkham | 139/446 |
| 3,987,822 | 10/1976 | Freisler | 139/449 |
| 4,112,983 | 9/1978 | Oderbolz | 139/446 |

FOREIGN PATENT DOCUMENTS

| | | | |
|---|---|---|---|
| 1535668 | 2/1970 | Fed. Rep. of Germany | 139/449 |

*Primary Examiner*—Henry Jaudon
*Attorney, Agent, or Firm*—Donald D. Denton

[57] ABSTRACT

A device for maintaining an insertion band against an oscillating insertion band wheel by providing a flexible element which is movable in oscillating fashion in synchronism with the insertion band and rests from the outside against the insertion band under an initial stress.

14 Claims, 7 Drawing Figures

BAND GUIDE FOR SHUTTLELESS LOOMS

BACKGROUND OF THE INVENTION

The present invention relates to an apparatus for the insertion of the weft thread on a shuttleless loom, having a band wheel which is driven in alternating direction of rotation, a flexible insertion band which bears an insertion member and which, while winding and unwinding on the circumference of the band wheel, is imparted an oscillating movement transverse to the warp threads, and a guide member for preventing the insertion band from lifting off from the circumference of the band wheel.

In one apparatus of this type, known from U.S. Pat. No. 4,010,776, several guide means are provided which are formed by elements in the shape of leaf springs bent at their one end, which grip over the insertion band at their bend end. These elements are fastened at their other end to the band wheel. In the vicinity of the circumference of the band wheel there are provided wedge-shaped control members, fixed in space, against which the guide members run and are thereby pushed away from the band wheel.

In this known apparatus, due to the sliding contact between guide and control members, there is very extensive stressing and wear at least of the control members, and a considerable development of heat. Furthermore, guide and control members constitute an additional and considerable source of noise on the loom. All of these disadvantageous properties of the known apparatus are further increased and even multiplied by the fact that the control members are arranged in the vicinity of the cicumference of the band wheel and therefore in a region of maximum relative speed between guide and control members.

In another apparatus of the aforementioned type known from U.S. Pat. No. 2,604,123, the guide members are formed by rollers which are supported along the circumference of the band wheel and press against the insertion band from the outside. These rollers have, to be sure, proven satisfactory with low speeds of insertion, but with the high speeds of insertion which are today desired, they become very hot and are subject to great wear. Furthermore, the rollers represent a considerable source of noise and also extensively wear down the insertion band.

SUMMARY OF THE INVENTION

By the present invention there is proposed an apparatus of the aforementioned type in which the wear of the known guide members as well as the resultant heat and the additional noise are reduced to a minimum.

This is achieved in accordance with the invention in the manner that the guide member is formed by a flexible element which is movable in oscillating fashion in synchronism with the insertion band and rests from the outside against the insertion band under an initial stress.

BRIEF DESCRIPTION OF THE DRAWINGS

The invention will be described in further detail below with reference to illustrative examples and the figures of the drawing, in which.

DESCRIPTION OF THE PREFERRED EMBODIMENTS

Figure 1:
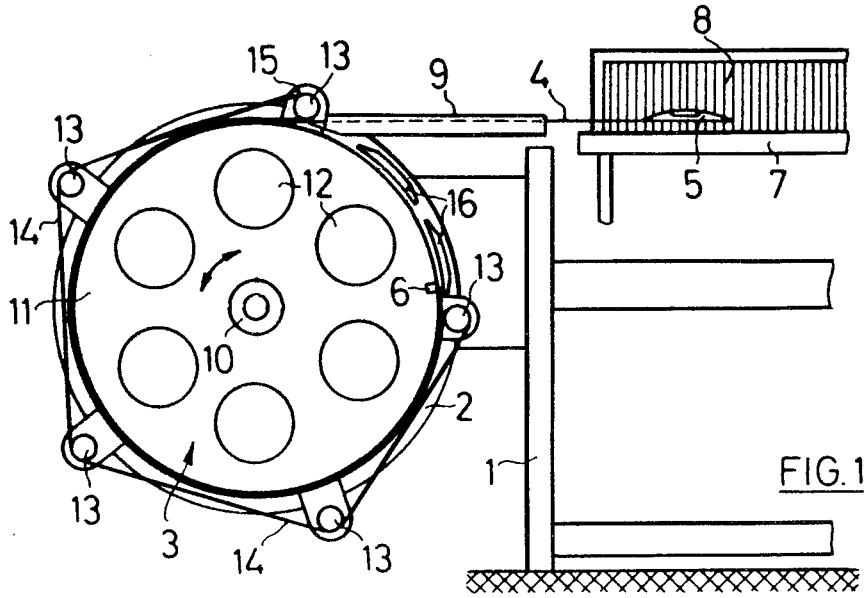
FIG. 1 shows a diagrammatic front view of the parts of a loom necessary for an understanding of the invention, which loom is provided with a first embodiment of a guide member for the insertion band in accordance with the invention.
Figure 4:
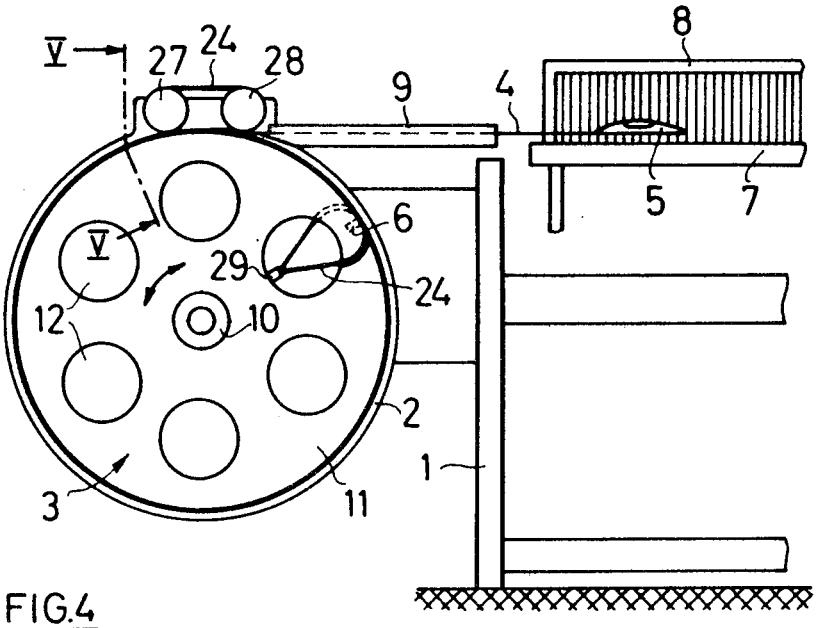
FIG. 4 shows a diagrammatic front view of the parts of a loom being provided with a third embodiment of a guide member in accordance with the invention.

Each of FIGS. 1 and 4 shows diagrammatically a portion of a loom of known construction, separate base plates 2 being supported on the machine frame 1 on its left and right sides to hold band or ribbon wheels 3 covered by removable covers (not shown). In the drawing only the left band wheel 3 of the loom has been shown, it being a mirror-image of the right band wheel; its cover has been removed. The filling threads are arranged in the form of a large supply to the side of the loom (not shown) and are offered to a first insertion head which is fastened to one end of a flexible insertion band which lies on the wheel rim of the right-hand band wheel and at its other end is connected to the wheel rim.

On the left-hand band wheel 3 there is fastened, in similar manner, a flexible insertion band 4 on whose free end there is mounted a second insertion head 5 and the other end of which is fastened by an element 6 to the band wheel 3. The band wheels are driven oscillating in opposite directions so that the two insertion heads are continuously moved up into the center of the shed (not shown) and then again pulled out of the shed. In the center of the shed, the filling thread is transferred from the first insertion head 5 to the second, whereupon the filling thread is introduced by the second insertion head 5 from the center of the shed into the second half of the shed. After the insertion has been effected, the filling thread is beaten up by reed 8, fastened to batten 7.

As a result of their connection between the band wheel 3 and the insertion band 4 by the element 6, the insertion band 4 is pulled upon winding and pushed upon unwinding.

Since the insertion band 4, upon the pushing during the acceleration phase and the pulling in the retardation phase is pressed outwards away from the circumference of the band wheel 3, a guide member is provided in the vicinity of the circumference of the band wheel 3 in order to prevent the insertion band 4 from lifting off from the band wheel 3. This guide member will be described in further detail below. Between the band wheel 3 and the shed a band guide 9 is provided.

The band wheel 3 is of known construction and consists preferably of a hub 10 and of a wheel body 11 arranged centrally on the hub 10 and consists of a suitable material which is provided with circularly arranged boreholes 12 in order to reduce its weight. A band wheel of this type is described, for instance, in U.S. Pat. No. 3,987,822 and in Swiss Patent Application No. 6,309/78-9.

Figure 5:
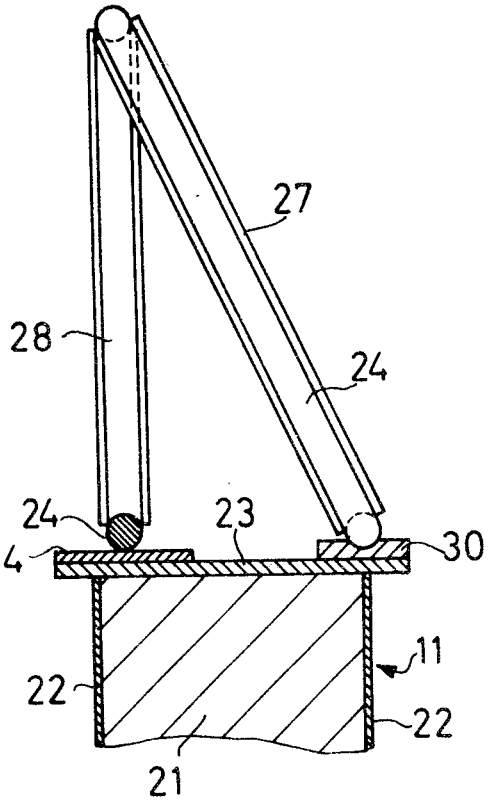
FIG. 5 is a section along the line V—V of FIG. 4.

The band wheel described in the said Swiss Patent Application has proven particularly suitable. In it, the wheel body 11 has a disk-shaped part which is composed of honeycombs that extend parallel to the axis of rotation of the band wheel 3 and are open on both sides. This honeycomb part, which consists of light metal or plastic, is covered on both side surfaces by thin circular disks and on its circumference by a foil. This construction of the wheel body 11 can be noted from FIG. 5, in which the honeycomb part is designated by the reference number 21, the lateral covering disks by 22, and the foil on the circumference by 23.

The guide member for preventing the insertion band 4 from lifting off from the band wheel 3 is formed, in accordance with FIG. 1, by an endless belt or flexible element 14 which is guided over rollers 13. The rollers 13 are supported for free rotation of flat roller supports 15 mounted on the base plate 2, and have a slightly barreled circumference. In accordance with the showing in the drawing, five rollers 13 are provided which are so distributed over the circumference of the band wheel 3 that the belt 14 wraps around about 280° of the circumference of the band wheel. The belt 15 lies against the outside of the insertion band 4 and presses the latter against the circumference of the band wheel 3.

Upon the oscillating movement of the band wheel 3 and of the insertion band 4, the belt 14 is carried along by the latter and also effects an oscillating movement. Since in this case there is no relative movement between insertion band 4 and belt 14, there is practically no heating of the belt 14, and the belt 14 and the insertion band 4 are excellently preserved. As a result of the low weight of the belt 14 and the rollers 13, no additional large moments of inertia need be overcome, which is extremely favorable for the designing of the drive of the band wheel 3. The use of the belt 14 is also extremely favorable from the standpoint of noise, since the rollers 13 and the belt 14 produce practically no additional noise whatsoever.

Since, on the one hand, the tension of the belt 14 is of considerable importance for the proper operation of the arrangement and on the other hand certain differences in length between individual belts 14 must be expected, it is advisable for at least one of the rollers 13 to be supported adjustable under spring action. For this there is selected one of the two end rollers 13 around which the belt 14 is deflected, preferably the roller arranged furthest to the right in the figure. The other rollers 13 are mounted fixed in position.

In order that the element 6 by which the insertion band 4 is fastened to the band wheel 3 does not damage the belt 14, an element 6 of the type described in U.S. Pat. No. 4,112,983 is used, which surrounds the edges of the insertion band 4 and clamps them fast while leaving the space between the edges substantially free. U.S. Pat. No. 4,112,983 by reference is made a part of this application. In this case, the width of the belt 14 is somewhat smaller than the free space between the clamped longitudinal edges of the belt 14.

The belt 14 may consist of any material having a low specific elongation. A belt which consists of an endlessly wound aromatic polyamide fiber, for instance the Kevlar produced by DuPont, wrapped with polyurethane has proven suitable.

Since the belt 14 cannot be deflected laterally without difficulty, it is difficult to arrange the belt 14 in such a manner that is surrounds the entire circumference of the band wheel 3. For this reason, when the belt 14 alone is used as guide member, the entire length of the circumference of the band wheel 3 is not available as stroke for the insertion head 5. If one proceeds, in the case of the embodiment shown in FIG. 1, from a band-wheel diameter of 70 cm, then, with the use of a belt 14 which surrounds about 280° of the circumference of the band wheel, there would be obtained a stroke of about 170 cm and accordingly a machine width of about 320 cm. If the total theoretically possible stroke of about 420 cm is to be utilized, then, in addition to the belt 14, there must also be provided other guide means for the insertion band 4. These guide means are formed, in accordance with FIG. 1, by two so-called band shoes 16, i.e. mechanical guide elements fixed in space along which the insertion band 4 slides. Since the band shoes 16 are arranged in a region in which the insertion band 4 still or again has a low speed, no disturbing influences result from the use thereof. As can be noted furthermore from FIG. 1, another roller 13 could be arranged directly below the guide 9 so that then, on the other hand, when using the belt 14 alone without band shoes 16, practically the entire theoretically possible stroke would be available or, on the other hand, this maximum stroke could be obtained with merely half a band shoe 16.

Figure 2:
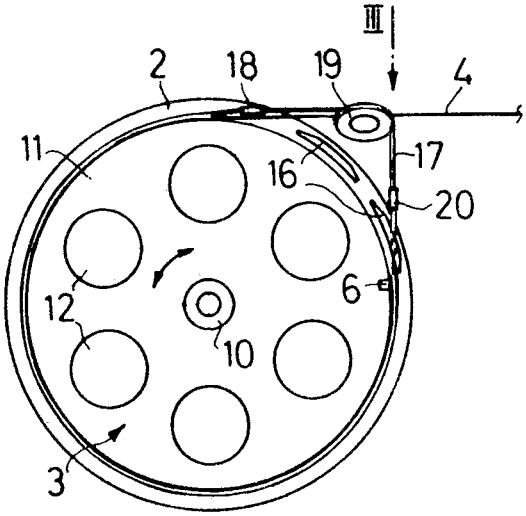
FIG. 2 shows a second embodiment of a guide member in accordance with the invention.
Figure 3:
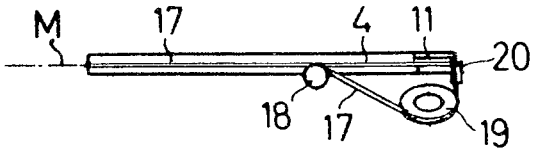
FIG. 3 shows a diagrammatic view seen in the direction of the arrow III of FIG. 2.

In the embodiment shown in FIGS. 2 and 3, which show the left-hand band wheel and a top view thereof respectively, the guide member or flexible element for the insertion band 4 is formed by an endless cable or rope 17. Since a cable cannot be bent as much as a belt, the cable 17 is passed around the entire band wheel 3. However, in this case, that region of the circumference of the band wheel 3, where the insertion band 4 moves tangentially away from and towards it, must be free of the cable 17. This is achieved in the manner that in this region the cable 17 is moved out of the plane of the band wheel 3 and then back into the plane of the band wheel. As shown in the drawing, as seen in the direction of travel of the insertion band 4 upon its unwinding from the band wheel 3, shortly behind the point where the insertion band 4 moves tangentially away from the band wheel 3, there is a first guide roller 18 by which the cable 17 is guided out of the plane of the band wheel 3 towards a deflection roller 19 which is arranged inclined to the plane of the band wheel. From the deflection roller 19 the cable 17 passes over a second guide roller 20 back into the plane of the band wheel 3 and again comes into contact with the insertion band 4.

The first and the second guide rollers 18 and 20 lie perpendicular to the plane of the band wheel 3 and guide the cable 17 in the central axis M of the insertion band 4. The deflection roller 19 lies in a plane which, referring to FIG. 2, extends from the band wheel 3 obliquely forward from the plane of the drawing. The guide rollers 18 and 20 and the deflection roller 19 are provided on their circumference with a guide groove for the cable 17.

Along that region of the circumference of the band wheel 3 in which the cable 17 is not in contact with the insertion band 4, two band shoes 16 are arranged, similar to FIG. 1. The lower band shoe in FIG. 2 is provided at its lower end with a slot for the passage of the cable 17.

The guide member for the insertion band 4, instead of being formed by an endless belt 14 (FIG. 1) or an endless cable (FIG. 2), could also be formed by a cut belt or cable. In case of the use of a cut belt its one end, preferably together with the insertion band 4, would be fastened by the element 6 to the band wheel 3. Above the band wheel 3, for instance at the place at which the uppermost roller 13 is arranged in FIG. 1, a winding roller for the belt would be mounted, the other end of the belt being fastened to its circumference. The winding roller would have to be driven by motor and for this purpose would be connected with the drive of the band wheel 3 via a gearing. Since the diameter of the winding roller would change continuously upon the winding and unwinding of the belt, the winding roller would, on the one hand, have to be spring-supported and, due to the continuously increasing or decreasing circumferential velocity of the winding roller, the gearing on the other hand would have to have a transmission ratio which decreases in the one direction of rotation and increases in the other direction of rotation.

When using a cut cable, the apparatus would have a similar appearance. Here, however, at the point of the winding roller there would be arranged a guide roller which is perpendicular to the plane of the band wheel, by which guide roller the cable would be deflected onto a winding drum, the longitudinal axis of which is parallel to the axis of the band wheel 3. The winding drum would be connected with the drive of the band wheel via a gearing. If the winding drum were wound with the cable only in a single layer, this gearing could have a fixed transmission ratio, provided that at the same time means were provided for displacing the winding drum in its longitudinal axis relative to the guide roller upon the winding and unwinding of the cable.

Figure 6:
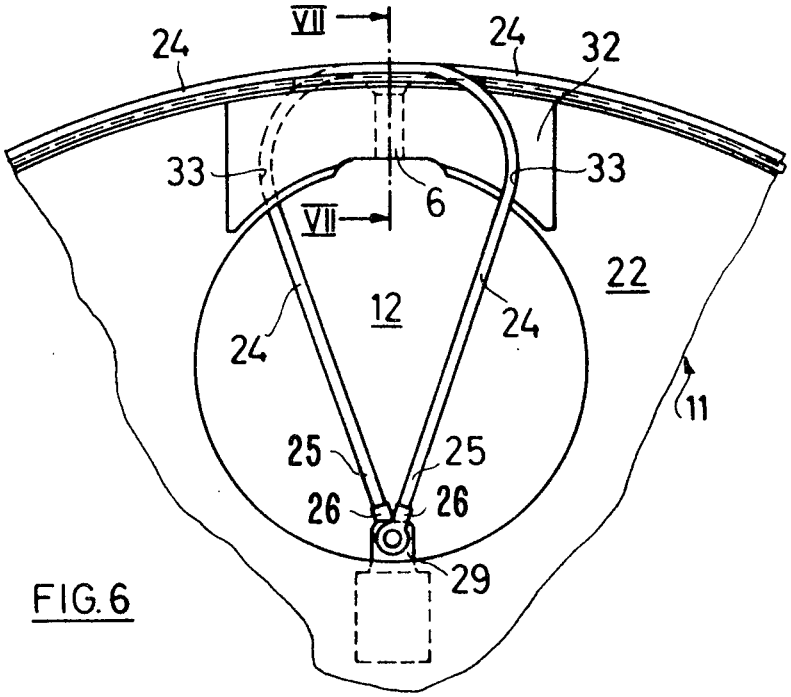
FIG. 6 shows a detail of FIG. 4 on a larger scale.

A preferred embodiment in which a cut cable or rope 24 is used as guide member is shown in FIGS. 4 to 7:

As shown in the FIGS. 4 and 6, the two ends 25 of the cable 24 are anchored to the band wheel 3. This cable 24 wraps around the entire circumference of the band wheel 3 and, in addition, moves over two rollers 27 and 28 which are tensioned with respect to each other by a spring (not shown). In this way, assurance is had that the cable 24 presses with a well-defined, adjustable initial stress from the outside against the insertion band 4.

The cable 24 is provided at each of its ends 25 with a lug 26, said lugs being fastened on an attachment lug 29 inserted into the wheel body 11 and extending into one of the boreholes 12. On the circumference of the band wheel 3 the cable 24 extends in two grooves; in the one groove it presses from the outside against the insertion band 4 while in the other groove it travels in a band guide 30 which is fastened on the foil 23, said band guide extnding in the region of the front edge of the cover disk 22 facing the viewer as seen in FIG. 4 over the entire circumference of the band wheel 3 and being provided with a guide groove for the cable 24. The one groove of the cable 24 and thus also the insertion band 4 lie accordingly in the region of the rear edge of the foil 23. The transfer between the grooves is effected by the rollers 27 and 28.

Each of the two rollers 27 and 28 is provided with a guide groove for the cable 24. These guide grooves lie at the point where the cable 24 is removed from the band wheel 3 and brought back to it again, in each case in the corresponding groove of the cable 24. The upper points of the guide grooves between which the cable 24 travels from one of the rollers 27, 28 to the other are aligned with each other. Accordingly, the planes which contain the rollers 27 and 28 respectively extend upwards towards each other so that the two normals to the grooves form, in the vertical section through the said planes, the two legs of a triangle. These two straight lines can be inclined by the same amount, in which case there would be obatined an equilateral triangle, or, as in the case of FIG. 5, the roller 28 can lie parallel to the plane of the band wheel 3 and therefore be perpendicular to the plane of the insertion band 4, while the roller 27 can be correspondingly inclined. The latter variant has proven particularly advantageous with respect to the lateral directional stability of the insertion band 4. Of course the rollers 27 and 28 can also have angles of inclination other than those described.

Figure 7:
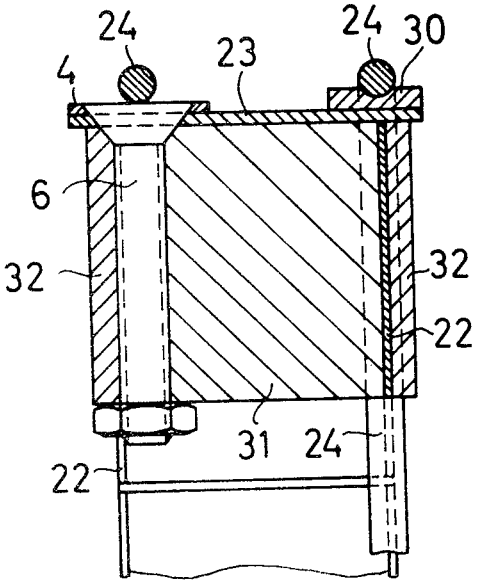
FIG. 7 shows a section along the line VII—VII of FIG. 6, on a larger scale.

As can be noted from FIGS. 6 and 7, an insert piece 31 can be inserted in the wheel body 11 in the region between the borehole 12 into which the fastening lug 29 extends and the circumference of the band wheel. This insertion piece 31 lies between the cover disks 22 and is connected with them and with the foil 23, preferably by cementing. Corresponding cover pieces 32 are provided on the outside of the cover disk 22 in the vicinity of the insertion member 31.

The insert member 31 serves to anchor the element 6, developed as a screw, for the fastening of the insertion band 4 on the band wheel 3 and for guiding the cable 24 from the circumference of the band wheel 3 to the fastening lug 29. For this purpose, the insertion member 31 together with the cover disks 22 and the cover pieces 32 has, at each end of the wheel 3, a circular arcuate groove 33 which is open towards said end. These grooves 33 extend from the circumferene of the band wheel to the adjacent borehole 12 in the wheel body 11 and in this way guide the cable 24 from the corresponding groove on the circumference of the band wheel toward the axis of the band wheel.

The cable 24 thus has the following path on the band wheel 3: The lug 26 on the cable end 25 is fastened to the rear side of the fastening lug 29, as seen with reference to FIGS. 4 and 6, and extends in the rear groove 33 to the circumference of the band wheel 3 and passes through the foil 23. The cable 24 is present here in its one groove which is associated with the roller 28 and passes over the end of the band fastened by the screw 6 to the band wheel 3 onto the insertion band 4. This position, in which the cable 24 presses the insertion band 4 against the surface of the sheet or foil 23 and thus against the circumference of the band wheel 3, is retained by the cable 24 up to the roller 28 by which it is deflected away from the band wheel 3 to the roller 27 and fed from the latter back to the band wheel 3. In this connection, the cable 24 passes through the roller 27 into its second groove on the band guide 30 and extends in the latter up to the point where the front groove 33 passes through the foil 23. Through the front groove 33, the cable 24 finally arrives at the fastening lug 29, on the front side of which it is fastened by the lug 26 at its ends 25.

The anchoring of the two cable ends 25 need not be effected in the manner shown. Practical experiments have shown that the cable ends 25 can also be fastened directly to the circumference of the band wheel 3 in the corresponding groove central plane. In such case the cable ends 25 are also each provided with a lug 26 and the lugs are fastened to the circumference of the band wheel, for instance by a screw.

It will be appreciated that any type of flexible biasing element or means that provides a substantially continuous biasing of the insertion band against the surface of the band wheel during oscillating of the insertion band may be employed, and that many other variations can be made within the skill of the art without departing from the spirit and scope of the invention illustrated, described, and claimed herein.

What is claimed is:

1. An apparatus for the insertion of the filling thread on a shuttleless loom having a band wheel driven in alternating directions or rotation, a flexible insertion band which bears an insertion member and is imparted, while being wound and unwound on the circumference of the band wheel, an oscillating movement transverse to the warp threads, and having a guide member to prevent the lifting of the insertion band from the circumference of the band wheel, characterized by the fact that the guide member is formed of a cable which is movable in oscillating fashion synchronously with the insertion band and rests from the outside against the insertion band under an initial stress.

2. The apparatus according to claim 1 in which said guide member is formed of an endless cable which surrounds the circumference of the band wheel except for that region in which the insertion band moves away from and toward the band wheel.

3. The apparatus according to claim 2 in which said cable is deflected laterally out of the plane of the band wheel in the said region.

4. The apparatus according to the claim 3 in which the deflecting of the cable is effected by two guide rollers arranged spaced apart along the circumference of the band wheel and the plane of which is perpendicular to the plane of the band wheel and by a deflection roller which is arranged between the guide rollers and inclined at an acute angle to the plane of the band wheel.

5. The apparatus according to claim 1 in which said guide member is formed of a cut cable, one end of which is fastened to the band wheel while its other end is fastened to a driven winding drum.

6. The apparatus according to claim 1 in which said guide member is formed by a cut cable the ends of which are fastened to the band wheel.

7. The apparatus according to claim 6 in which two rollers are arranged in the vicinity of the place where the insertion ribbon moves tangentially away from the band wheel and said cable is guided over said rollers.

8. The apparatus according to claim 7 in which one of the two rollers is supported adjustably under spring action with respect to the other.

9. The apparatus according to claim 7 or 8 in which said cable travels on the circumference of the band wheel in two spaced grooves, the one groove lying in the longitudinal axis of the insertion band whereas the other groove lies alongside the insertion band.

10. The apparatus according to claim 9 in which the groove of the cable arranged alongside the insertion band on the circumference of the band wheel is provided with a guide for the cable.

11. The apparatus according to claim 10 in which the deflecting of the cable from one of the said grooves into the other is effected by said two rollers.

12. The apparatus according to claim 11 in which each of said two rollers has a guide groove for the cable, and on the side of the rollers facing the band wheel, the cable tangents between the rollers and the corresponding grooves on the band wheel lie on the lines of intersection of the corresponding central planes while on the side of the rollers facing away from the band wheel, the cable tangents to the rollers lie on the lines of intersection of the two roller central planes.

13. The apparatus according to claim 12 in which the roller associated with the one groove of the cable is arranged parallel to the central plane of the band wheel and the other roller associated with the other groove is arranged at a corresponding inclination.

14. The apparatus according to claim 13 in which the cable is guided in the vicinity of its ends from the grooves on the circumference of the band wheel towards the hub of said band wheel and is anchored in the corresponding central planes of the grooves in the vicinity of said hub.

* * * * *